US010005526B2

(12) United States Patent
White

(10) Patent No.: US 10,005,526 B2
(45) Date of Patent: Jun. 26, 2018

(54) APPARATUS AND METHOD FOR POWERING A VESSEL WITH WIND

(71) Applicant: Chris White Designs LLC, South Dartmouth, MA (US)

(72) Inventor: Christopher R. White, South Dartmouth, MA (US)

(73) Assignee: Chris White Designs LLC, South Dartmouth, MA (US)

( * ) Notice: Subject to any disclaimer, the term of this patent is extended or adjusted under 35 U.S.C. 154(b) by 0 days. days.

(21) Appl. No.: 15/492,069

(22) Filed: Apr. 20, 2017

(65) Prior Publication Data

US 2017/0305512 A1 Oct. 26, 2017

Related U.S. Application Data

(60) Provisional application No. 62/325,781, filed on Apr. 21, 2016.

(51) Int. Cl.

| | |
|---|---|
| ***B63B 39/06*** | (2006.01) |
| ***B63B 3/38*** | (2006.01) |
| ***B63H 9/06*** | (2006.01) |
| ***B63B 35/00*** | (2006.01) |
| ***B63H 25/38*** | (2006.01) |

(52) U.S. Cl.

CPC ..... *B63B 39/06* (2013.01); *B63B 3/38* (2013.01); *B63B 35/00* (2013.01); *B63H 9/06* (2013.01); *B63H 25/38* (2013.01); *B63B 2003/385* (2013.01); *B63B 2035/009* (2013.01); *B63B 2207/00* (2013.01)

(58) Field of Classification Search

CPC ..... B63B 39/06; B63B 3/08; B63B 35/00

USPC ..... 114/39.21

See application file for complete search history.

(56) References Cited

U.S. PATENT DOCUMENTS

| | | | | | |
|---|---|---|---|---|---|
| 5,152,238 | A * | 10/1992 | Page | B63B 41/00 | 114/143 |
| 5,163,377 | A * | 11/1992 | Calderon | B63B 15/0083 | 114/125 |
| 5,509,368 | A * | 4/1996 | Wald | B63B 15/0083 | 114/39.21 |
| 6,378,449 | B1 * | 4/2002 | Leblanc | B63B 15/02 | 114/91 |
| 6,453,836 | B1 * | 9/2002 | Ditmore | B63B 39/06 | 114/136 |
| 6,863,008 | B2 * | 3/2005 | Gonen | B63H 9/1021 | 114/102.26 |
| 6,886,481 | B1 * | 5/2005 | Lord | B63B 1/30 | 114/140 |
| 6,923,131 | B2 * | 8/2005 | Petrovich | B63B 35/792 | 114/136 |
| 7,243,607 | B2 * | 7/2007 | Chesney | B63B 1/24 | 114/274 |
| 7,644,672 | B2 * | 1/2010 | Welbourn | B63B 39/06 | 114/274 |
| 2008/0216728 | A1 * | 9/2008 | Hofbauer | B63B 1/286 | 114/39.25 |

(Continued)

*Primary Examiner* — S. Joseph Morano
*Assistant Examiner* — Jovon Hayes
(74) *Attorney, Agent, or Firm* — McCarter & English, LLP; Elizabeth A. Hanley; Mei Bai

(57) ABSTRACT

Embodiments of the present apparatus and method feature a permanently fixed canted keel. The apparatus and method feature tacking maneuvers which shift the sail element and reverse the direction of the hull form.

7 Claims, 6 Drawing Sheets

(56) References Cited

U.S. PATENT DOCUMENTS

| | | | | |
|---|---|---|---|---|
| 2012/0048165 | A1* | 3/2012 | Westerman | B63B 39/06<br>114/126 |
| 2014/0283725 | A1* | 9/2014 | Jouffroy | G05D 1/0875<br>114/39.29 |

* cited by examiner

APPARATUS AND METHOD FOR POWERING A VESSEL WITH WIND

RELATED APPLICATIONS

This application claims priority to and benefit of U.S. Provisional Application Ser. No. 62/325,781 Filed Apr. 21, 2016 for "Apparatus and Method for Powering a Vessel with Wind. The entire content of such application is incorporated herein by reference.

STATEMENT REGARDING FEDERAL SPONSORSHIP

Embodiments of the present invention were not conceived or reduced to practice with Federal funds or sponsorship.

BACKGROUND OF THE INVENTION

Embodiments of the present invention are directed to sailing craft. Embodiments have particular application for autonomous craft that spend prolonged periods at sea without human involvement.

It is advantageous to power such craft with wind because it is ubiquitous. However, powering a vessel with wind involves complicated wind collecting devices, such as sails, foils and wings and positioning the wind collecting device advantageously for a selected course.

Further, the vessel needs to have a positive righting force that prevents the vessel from inverting, and sustains the wind collecting devices in a proper orientation for power generation.

SUMMARY OF THE INVENTION

Embodiments of the present invention are directed to an apparatus and method for powering a vessel with wind. One embodiment of the apparatus is for movement at the interphase of a first fluid body comprising a liquid and a second fluid body comprising a gas. For example without limitation, the apparatus moves along the surface of a body of liquid such as water. The apparatus comprises a hull form having buoyancy in the first body to float at the interphase of the first fluid body and the second fluid body, the hull form having an upper hull surface, bottom hull surface, first hull end, second hull end, first hull side and a second hull side. The first hull end and second hull end define a hull mid-line and a mid-plane with the mid-plane, running between the first hull side and second hull side. The hull form is substantially symmetrical about the mid plane. The upper hull surface is for positioning towards the second fluid and the bottom hull surface for immersion in the first fluid. A keel element is affixed to and descends from the hull bottom surface. The keel element has a first keel end toward the first hull end, a second keel end towards the second hull end, a first keel side surface facing towards the first hull side and a second keel side surface towards the second hull side. The keel element and hull form have a line of attachment which line of attachment is parallel to or on a line between the first hull end and the second hull end. The keel element has at least a one segment in which the first keel side surface and second keel side surface have an offset angle toward the first hull side. A sail element projects from the hull upper surface about the mid-line for receiving and responding aerodynamically to relative movement of the first fluid body and the second fluid body. The hull form has an at rest position in which the sail element is not receiving and responding to relative movement of the first fluid body and the second fluid body and a power position in which the sail element is receiving and responding to the relative movement of the first fluid body and the second fluid body. In the at rest position, the sail element and the interphase of the first fluid body and the second fluid body define a first rest angle towards the first side and a second rest angle towards the second side. The first rest angle is smaller than the second rest angle, and in the power position the sail element and the interphase of the first fluid body and the second fluid body define a first power angle towards the first side and a second power angle towards the second side, the first power angle is larger than the first rest angle and approaches or exceeds the second power angle. The apparatus tacking by turning the hull form and keel element, to place the first hull side toward the apparent direction of the second fluid body, and reversing the direction.

The sail element may take several forms such as, by way of example, without limitation, sails comprising flexible sheets supported by booms, masts lines and the like of the type characterized by main sails, jibs, cambered sails and the like, foils, wings. Embodiments of the present invention feature a sail element that is rotatably affixed to the hull form. The rotation of the sail element defines a sail element axis of rotation which is used in the context of the Figures as a centerline. The offset of the keel element may be calculated from the sail element axis or such centerline. Where the hull form deviates from side to side, the sail element axis is used as a reference. The offset may be 10-30 degrees from the sail element axis or centerline, or, in some embodiments, 15-25 degrees, or, as described 20 degrees.

The sail element can be operated and adjusted for different wind speeds and directions by moving the rotation to present an air foil or aerodynamic shape or in a non-power position feathering the form. An operator or controller can control the sail through lines, gears, motors, servo tab structures, ring gears or wing spars, motors equipped with pinion gears, chains, cogged belts and the like. As used herein, the term "operator" refers to a human who is with the apparatus as in riding such apparatus, or controlling the apparatus remotely through signal communication devices such as electromagnetic or photonic transmission and receiving devices. The term "controller" refers to a computer type device characterized by computer processing units which receive instructions and effect such instructions over time by generating command signals which are received by motors and the like.

One embodiment comprises a first rudder element towards the first end of the hull form and a second rudder element towards the second end. The rudder elements can be active or passive. As used herein the term "active" refers to rudders that are rotatably affixed to the hull form and a change in hull form direction is implemented by turning the rudder with respect to the hull form. Passive rudders impart direction to the hull form but do not turn with respect to the hull form to which they are affixed. Steering of the hull form equipped with passive rudders is effected by shifting weight and using the pressure of the sail element to power the hull form in a different direction.

One embodiments of the present invention which feature operators is suited as a recreational vessel. Such embodiments feature a cockpit constructed and arranged for the operator to sit or stand. In the alternative the operator may stand on the hull form and steer by shifting weight and positioning the sail element. The hull form may comprise foot straps and/or braces to aid in controlling the hull form.

One embodiment of the present invention is directed to an apparatus having a controller with an active rudder controlled by a rudder servo motor and a sail element controlled by a sail control element. The controller is in signal communication with the rudder servo motor and the sail element to set a course for the hull form by direction the first rudder and second rudder to turn and set a sail position in cooperation with the course to power the apparatus.

The sail control element may take several forms. The sail element may comprise a servo tab and the position of the servo tab may be adjusted to position the sail element. In the alternative, the sail element can be held by one or more lines or spars which can move the sail element about the mast. In the power position, the sail element will have the forward aspect of the sail or foil towards the first side and to which the keel element is offset and does not need to have complete freedom of rotation. Or, in a further alternative, the sail element is fixed to a ring gear or similar attached to the wing spar which goes thru the deck and steps on the hull bottom. The ring gear is driven by a motor driven pinion gear that can position the wing anywhere in 360 deg and hold it in place. A spar or the mast may also be mechanically coupled to a cogged belt, chain, and a motor driven pinion gear.

One embodiment of the method is directed to the movement an apparatus at the interphase of a first fluid body comprising a liquid and a second fluid body comprising a gas. The apparatus comprises a hull form having buoyancy in the first body to float at the interphase of the first fluid body and the second fluid body, the hull form having an upper hull surface, bottom hull surface, first hull end, second hull end, first hull side and a second hull side. The first hull end and second hull end define a hull mid-line and a mid-plane with the mid-plane, running between the first hull side and second hull side. The hull form is substantially symmetrical about the mid plane. The upper hull surface is for positioning towards the second fluid and the bottom hull surface for immersion in the first fluid. A keel element is affixed to and descends from the hull bottom surface. The keel element has a first keel end toward the first hull end, a second keel end towards the second hull end, a first keel side surface facing towards the first hull side and a second keel side surface towards the second hull side. The keel element and hull form have a line of attachment which line of attachment is parallel to or on a line between the first hull end and the second hull end.

The keel element has at least a one segment in which the first keel side surface and second keel side surface have an offset angle toward the first hull side. A sail element projects from the hull upper surface about the mid-line for receiving and responding aerodynamically to relative movement of the first fluid body and the second fluid body. The hull form has an at rest position in which the sail element is not receiving and responding to relative movement of the first fluid body and the second fluid body and a power position in which the sail element is receiving and responding to the relative movement of the first fluid body and the second fluid body. In the at rest position, the sail element and the interphase of the first fluid body and the second fluid body define a first rest angle towards the first side and a second rest angle towards the second side. The first rest angle is smaller than the second rest angle, and in the power position the sail element and the interphase of the first fluid body and the second fluid body define a first power angle towards the first side and a second power angle towards the second side, the first power angle is larger than the first rest angle and approaches or exceeds the second power angle. The apparatus tacking by turning the hull form and keel element, to place the first hull side toward the apparent direction of the second fluid body, and reversing the direction. The method further comprising the step of tacking by turning the hull form and keel element, to place the first side toward the apparent direction of the second fluid body, and reversing direction.

A further embodiment of the present method comprises the step of providing a controller and programming the controller to tack by turning the hull form and keel element to place the first side toward the apparent direction of the second fluid body and reversing direction.

One embodiment comprises the step of programming a course in the controller and the controller calculates or plots series of steps to consistent with the course through a series of tacks.

These and other features and advantages will be apparent to those skilled in the art upon viewing the drawing that are briefly described in the section below and upon reading the detailed description that follows.

DETAILED DESCRIPTION OF THE INVENTION

Figure 1A:
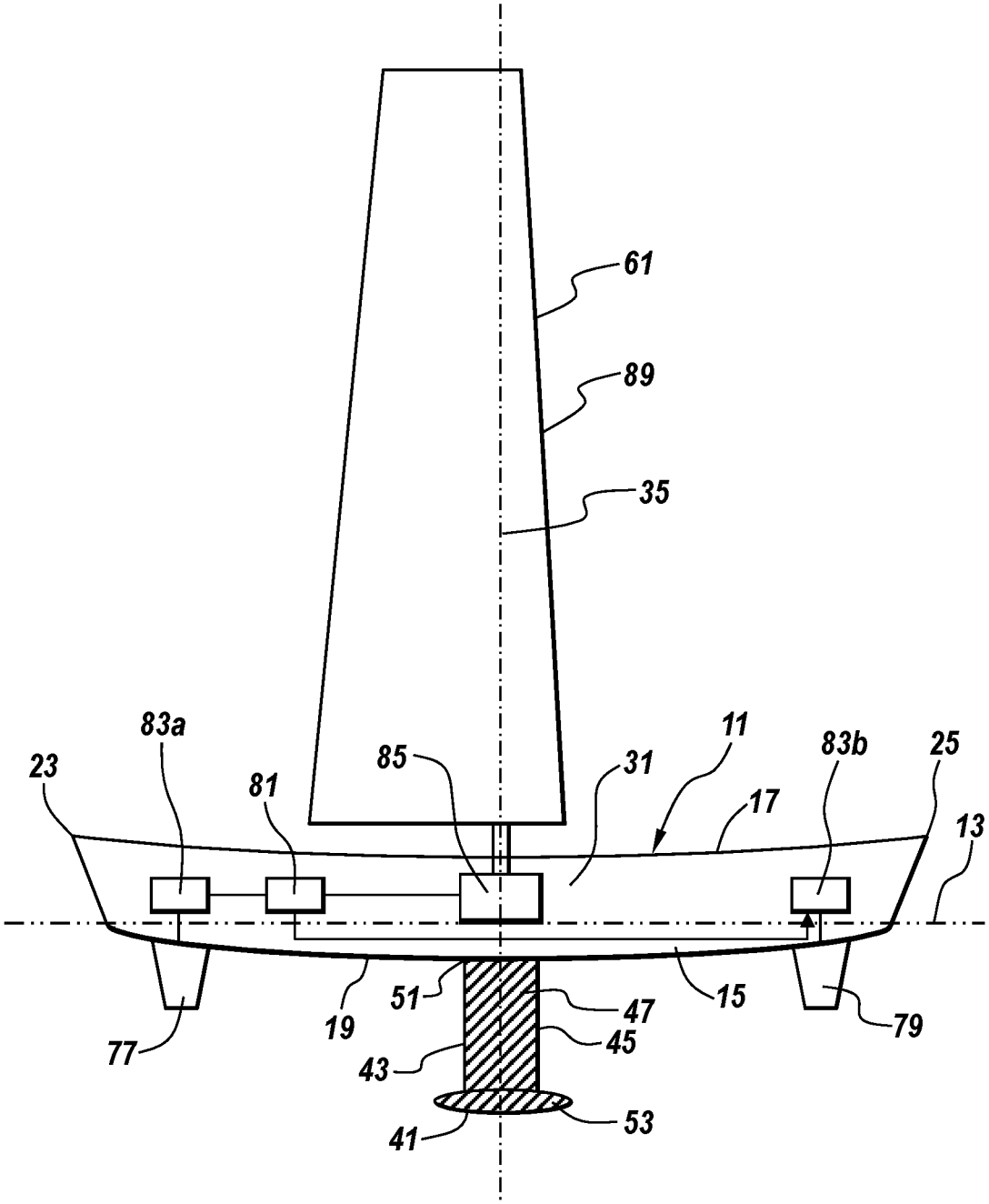
FIG. 1*a* depicts, a profile view of an apparatus embodying features of the present invention.

In order to resist the overturning forces of sails many sailing watercraft incorporate a weighted fin or ballast keel projecting from the hull bottom. As the sails are displaced to leeward due to wind pressure on the sails, rotating the boat around its longitudinal axis, the keel is also displaced to windward. The horizontal displacement of the weight of the ballast keel from the center of buoyancy of the immersed hull forms a force couple that resists the boat rolling from wind pressure against the sails, typically known as the restoring force.

This restoring force is proportional to the horizontal separation of the vessel center of buoyancy from the keel center of gravity. Normally when at rest a ballasted sailboat stands vertically and the restoring force from the keel is quite small. However at substantial angles of heel the keel is displaced a much larger horizontal distance from the hull center of buoyancy and the restoring forces are much greater.

The above describes the conventional form of a ballasted sailing vessel and it has been in use for centuries. Where it falls short is that the maximum restoring forces do not occur until the sails are tilted a large angle away from the wind. This "spills" the wind from the sails robbing them of some of their power to propel the boat forward.

In recent years some sailing craft have employed a ballast keel that can swing side to side in relation to the hull and sails. This permits the keel to be shifted to windward, providing a larger restoring force, while at the same time allowing the sails to stand more vertically to the wind capturing more of the wind energy. These "swing keel" boats are typically substantially faster as result.

While the swinging keel has numerous advantages it comes at a cost of considerable complexity of manufacture and operation. The forces required to move and hold the keel are high and if not engineered and constructed with great care failures that can cause injury or loss of the vessel can result.

A dramatic simplification can be obtained by installing the ballast keel at a fixed angle to the vessel vertical center line. For illustration purposes assume this to be a 20 degree angle. Although this discussion is keyed to a vertical center line, the off-set can be set with respect to the mast or sail element. Although this discussion assumes an approximately 20 degree angle, the angle can be set to between approximately 10 and 30 degrees, or approximately 15 and 25 degrees. As used in this context, the term "approximately" or "about" means within five degrees.

At rest in no wind the keel would hang directly beneath the hull and the mast would tilt at a approximately 20 degree angle from vertical. As the sails fill with wind the mast will start to rotate the hull toward a vertical position and the ballast keel will be displaced to windward. When there is sufficient wind for fast sailing the mast will be standing nearly vertical while the keel is shifted well to windward providing more power in a manner similar to the swinging keel design.

However, boats cannot sail directly into the wind and commonly make progress directly to windward by "tacking" which is a maneuver where the boat changes direction so that the wind comes across the deck from the opposite side as previously.

The permanently angled keel, which was a great improvement on one tack is a great detriment on the opposite tack. The boat will heel away from the wind an excessive amount resulting in very poor performance.

Embodiments of the present invention will now be discussed in detail as an apparatus and method for powering a vessel with wind. Embodiments of the present invention feature an apparatus or boat symmetrical fore and aft and incorporating a sailplan that can be reversed in direction. Instead of tacking in the conventional manner the boat is turned end for end so that what was the bow is now the stern and the angled ballast keel is still positioned to the windward side.

Turning now to FIG. 1*a*, an apparatus embodying features of the present invention, generally designated by the numeral 11 is depicted. The term apparatus or vessel will be used interchangeably in this discussion. The apparatus 11 is for movement at the interphase of a first fluid body comprising a liquid and a second fluid body comprising a gas. For example, without limitation, the apparatus moves along the surface of a body of liquid such as water, the interphase being denoted by numeral 13. However, embodiments of the present invention can be used for discovery and exploration on planets where the interphase of a liquid and a gas may be of a different nature, for example, without limitation, a liquid of higher carbon hydrocarbons and a gas of methane. This discussion will use the term "water" for the first fluid and "air" for the second fluid.

The apparatus 11 comprises a hull form 15 having buoyancy in the first body, the liquid, water, to float at the interphase 13 of the first fluid body, water and the second fluid body, air. The hull form 15 has an upper hull surface 17, bottom hull surface 19, first hull end 23, second hull end 25, first hull side 31 and a second hull side 33. The upper hull surface 17 is for positioning towards the second fluid and the bottom hull surface 19 is for immersion in the first fluid.

Figure 1B:
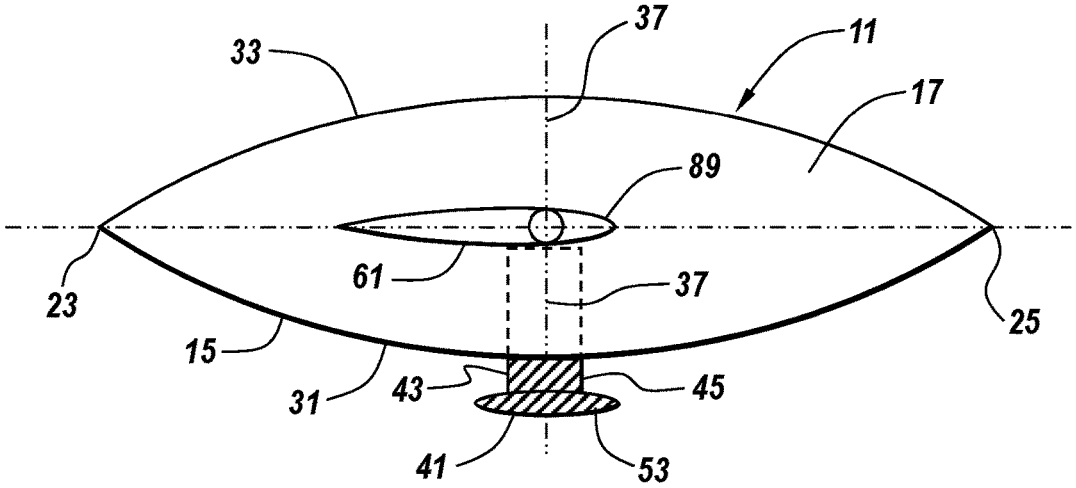
FIG. 1*b* depicts a plan view of an apparatus embodying features of the present invention.

The first hull end 23 and second hull end 25 define a hull mid-line 35, as best seen in FIG. 1*a* and a mid-plane 37 with the mid-plane 37, running between the first hull side 31 and second hull side 33, as best seen in FIG. 1*b*. The hull form 15 is substantially symmetrical about the mid plane 37.

A keel element 41 is affixed to and descends from the hull bottom surface 19. The keel element 41 has a first keel end 43 toward the first hull end 23, a second keel end 45 towards the second hull end 25. A first keel side surface 47 faces towards the first hull side 31 and a second keel side surface 49 faces towards the second hull side 33. The keel element 41 and hull form 15 have a line of attachment 51 as best seen inn FIG. 1*c*, which line of attachment 51 is parallel to or on a line between the first hull end 23 and the second hull end 25.

Figure 1C:
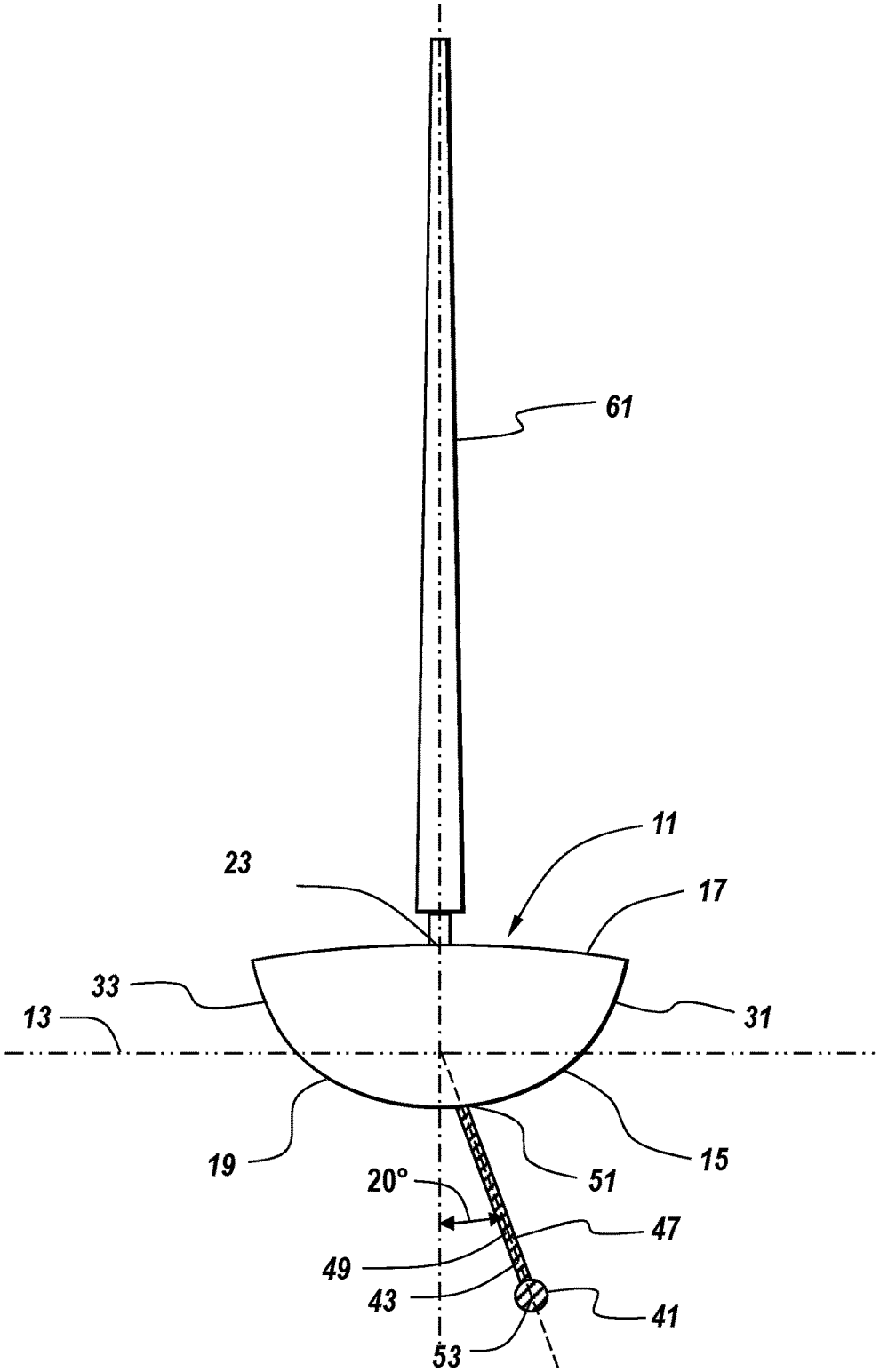
FIG. 1*c* depicts a section view of an apparatus embodying features of the present invention.

A ballast bulb 53 is fixed to the end of the keel element 41. The keel element 41 has at least a one segment in which the first keel side surface 47 and second keel side surface 49 have an offset angle toward the first hull side 31. This offset angle, as best seen in FIG. 1*c*, is about 10 to 30 degrees from the mid-line 35, or about 15-25 degrees, or, as depicted about 20 degrees.

Figure 2:
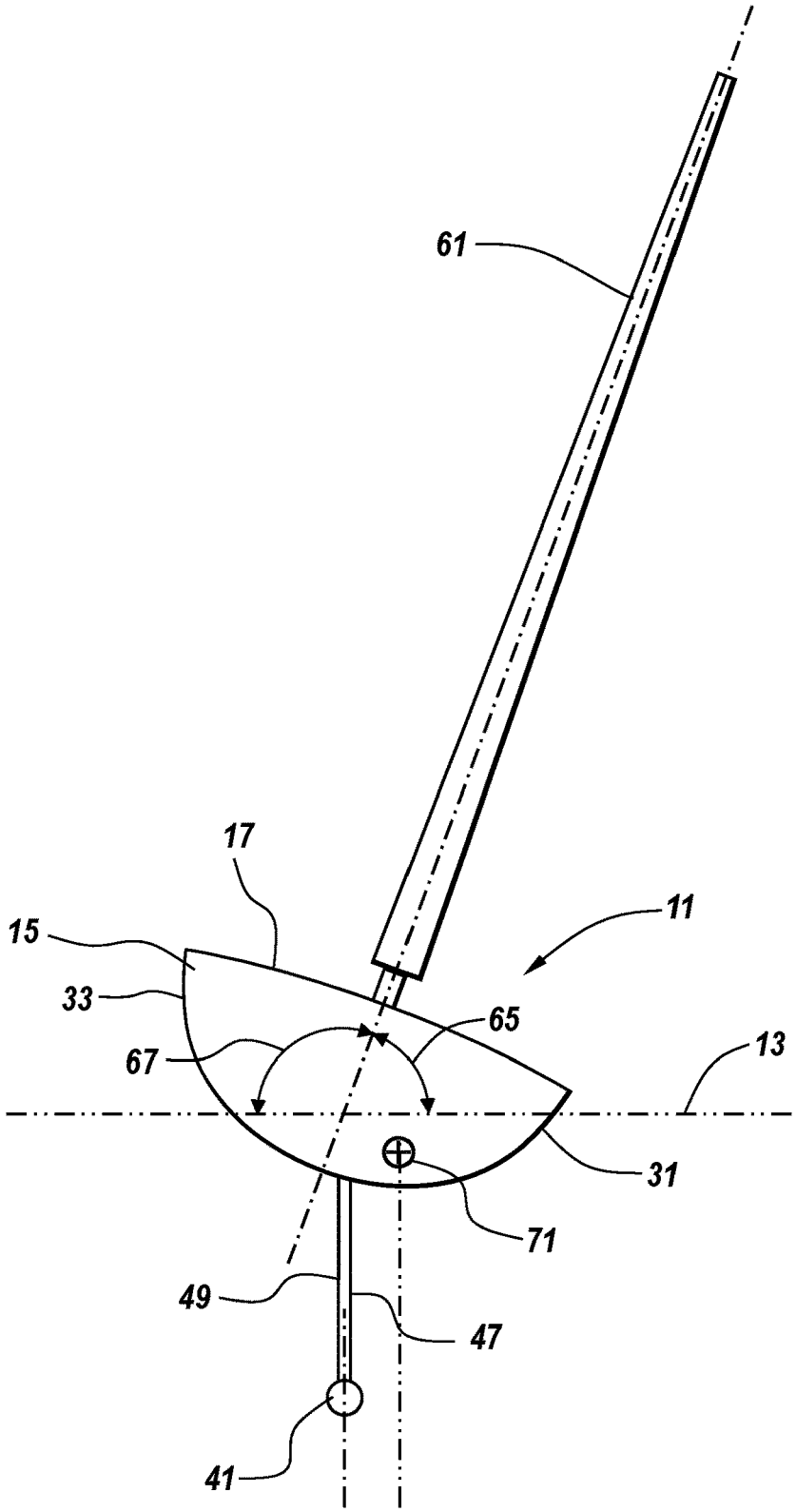
FIG. 2 depicts a section view of an apparatus embodying features of the present invention at rest with little or no wind.

A sail element 61 projects from the hull upper surface 17 about the mid-line for receiving and responding aerodynamically to relative movement of the first fluid body, water, and the second fluid body, air. The hull form 15 has an at rest position in which the sail element 61 is not receiving and responding to relative movement of the first fluid body, water, and the second fluid body, air. This "no wind" position is best seen in FIG. 2. The hull form 15 has a power position in which the sail element 61 is receiving and responding to the relative movement of the first fluid body, water, and the second fluid body, air. This "strong wind" position is best seen in FIG. 3.

Returning now to FIG. 2, in the at rest position, the sail element 61 and the interphase, waterline 13, of the first fluid body, water, and the second fluid body, air, define a first rest angle 65 towards the first side 31 and a second rest angle 67 towards the second side 33. The first rest angle 65 is smaller than the second rest angle 67. The first rest angle is less than 90 degrees. The second rest angle is greater than 90 degrees. The center of buoyancy 71 is towards the first side 31 of the hull form 15.

Figure 3:
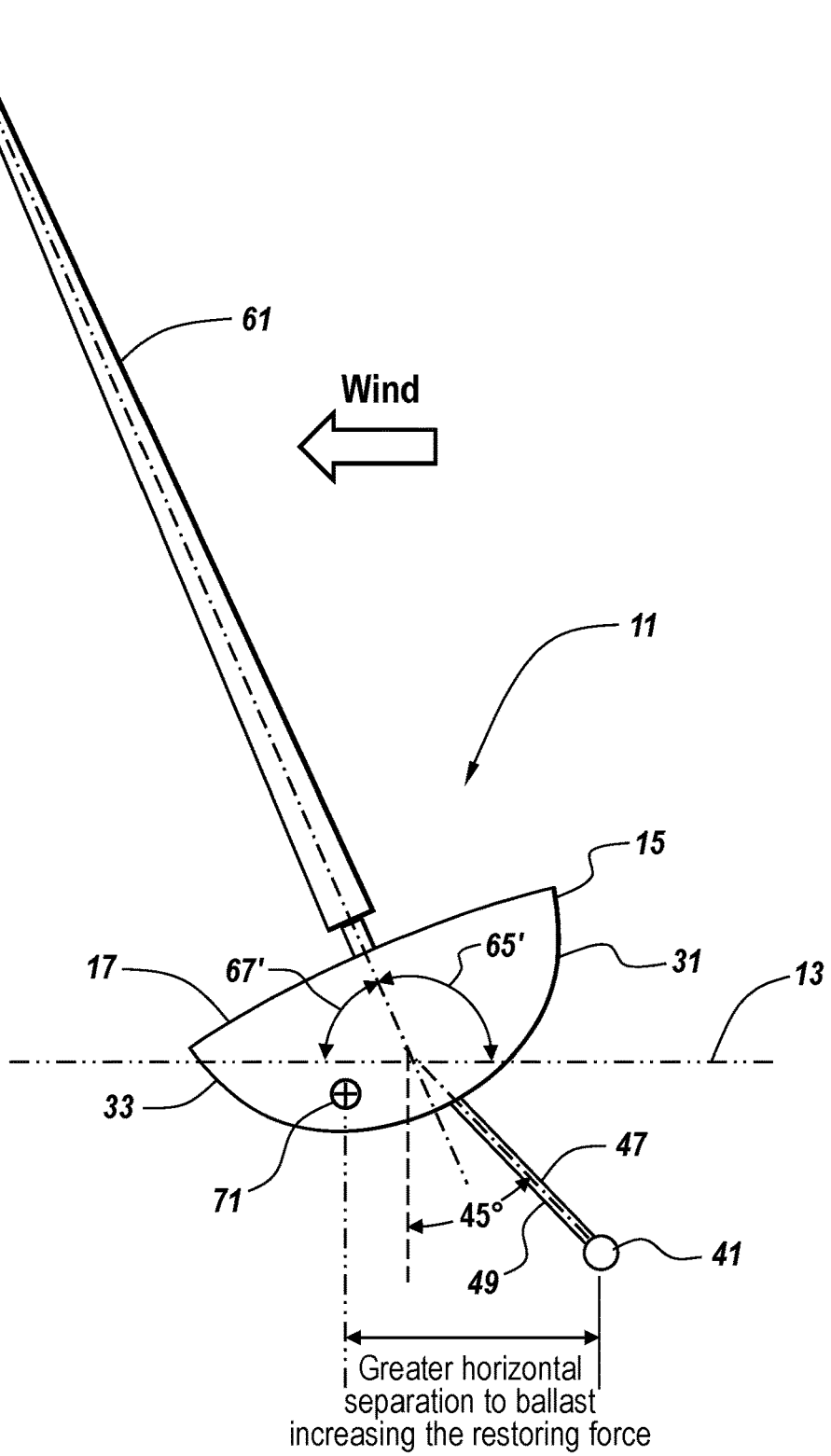
FIG. 3 depicts a section view of an apparatus embodying features of the present invention in a power position in strong wind.

Now turning to FIG. 3, in the power position the sail element 61 and the interphase, waterline 13, of the first fluid body, water, and the second fluid body, air, define a first power angle 65' towards the first side 31 and a second power angle 67' towards the second side 33. The first power angle 65' is larger than the first rest angle 65 and approaches or exceeds the second power angle 67'. The second power angle 67' approaches the magnitude and can be less than the first rest angle 65. The center of buoyancy, as depicted in FIG. 3, has shifted from the rest position, towards the second hull side 33.

Figure 4:
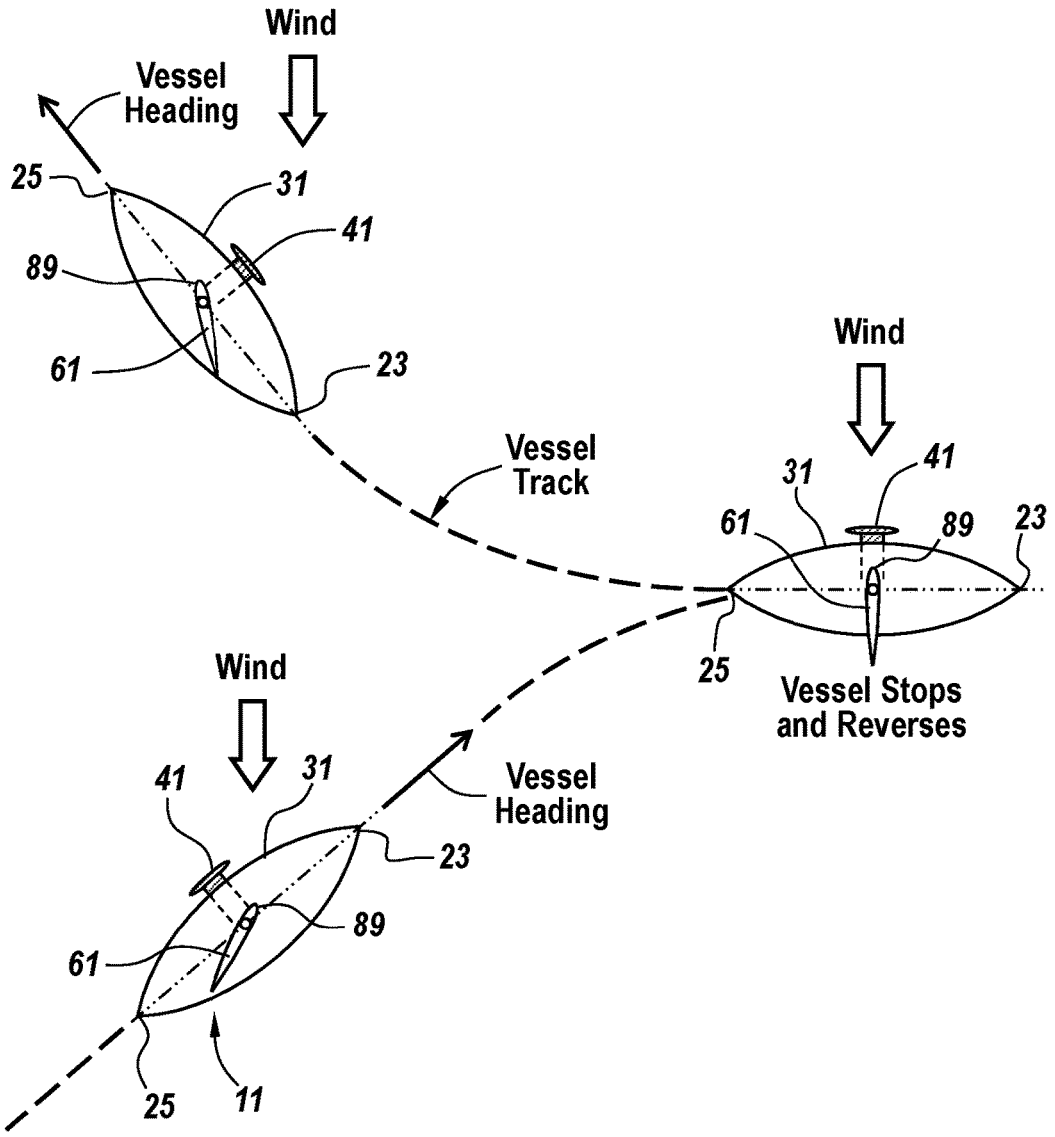
FIG. 4 depicts a plan view of an apparatus embodying features of the present invention moving through a tacking maneuver.

Turning now to FIG. 4, the lower portion of the figure depicts the apparatus 11 moves towards the wind on a tack with the keel element 41, and the first hull side 31 towards the wind direction with the first end 23 leading. Next in time the middle portion depicts the apparatus 11 by bringing the apparatus 11 to a stop, turning the hull form 15 and keel element 41, to place the first hull side 31 toward the apparent direction of the second fluid, air, the apparent wind direction. Then, at the top of FIG. 4, the apparatus 11 reversing the direction, with the second end 25 leading, the first hull side 31 and the keel 41 remaining to the wind.

The sail element 61 may take several forms such as, by way of example, without limitation, sails, comprising flexible sheets supported by booms, masts lines and the like of the type characterized by main sails, jibs, cambered sails and the like, foils, wings. These sails, foils and wings may be operated and controlled in conventional ways with manual lines. Personal watercraft sized hull forms 15 may have foils, sails and wings supported and controlled by manually operated booms and control arms. These can be operated by the user as the user stands on the hull form 15 or sits on or in the hull form 15.

As depicted in the Figures, the sail element 61 is rotatably affixed to the hull form. The rotation of the sail element 61 defines a sail element axis of rotation which is used in the context of the Figures as a centerline 35. The term "rotatably" is used in the sense that the sail element 61 is turnable and/or adjustable about an axis. The sail element 61 does not need to be freely rotatable 360 degrees. The offset of the keel element 41 may be calculated from the sail element axis or such centerline 35. The hull form 15 may deviate from side to side, to allow a larger platform to windward for users to shift their respective weight with respect to personal watercraft sized vessels.

The sail element 61 can be operated and adjusted for different wind speeds and directions by moving the rotation to present an air foil or aerodynamic shape or in a non-power position feathering the form. An operator or controller can control the sail through lines, gears, motors, servo tab structures, ring gears or wing spars, motors equipped with pinion gears, chains, cogged belts and the like known in the art [not shown]. As used herein, the term "operator" refers to a human who is with the apparatus as in riding such apparatus, or controlling the apparatus remotely through mechanical means and/or signal communication devices such as electromagnetic or photonic transmission and receiving devices. The term "controller" refers to a computer type device characterized by computer processing units which receive instructions and effect such instructions over time by generating command signals which are received by motors and the like.

Returning now to FIG. 1*a*, a first rudder element 77 descends downwardly from the hull form towards the first end 23 and a second rudder element 79 descends downwardly from the hull form 15 towards the second end 25. The rudder elements 77 and 79 can be active or passive. As used herein the term "active" refers to rudders that are rotatably affixed to the hull form and a change in hull form 15 direction is implemented by turning the rudder element 77 and/or 79 with respect to the hull form 15. Passive rudders elements impart direction to the hull form but do not turn with respect to the hull form to which they are affixed. Steering of the hull form equipped with passive rudders is effected by shifting weight and using the pressure of the sail element to power the hull form in a different direction. Passive rudder elements may be smaller or omitted particularly for personal watercraft operated by an operator who stands on the apparatus 11 and steers by shifting weight. The hull form 15 may comprise foot straps and/or braces [not shown] to aid in controlling the hull form. Embodiments which feature a cockpit [not shown] in the manner of a conventional pleasure sailing craft may find an active rudder element 77 and 79 suitable.

One embodiment of the present invention, as depicted in FIG. 1*a*, is directed to an apparatus 11 having a controller 81 with at least one active rudder 77 and 79 controlled by a rudder servo motors 83*a* and 83*b*. The controller 81 also controls the sail element 61 by a control element 85. The controller 81 is in the nature of a receiver receiving optical, electromagnetic signals, radiowaves from one or more transmitters [not shown] or the controller can have self directing features programmed in to a computer programming unit (CPU). CPUs are known in the art and are commonly found in computers, mobile phones and the like. The self directing controller 81 may also receive and transmit signal to receivers and transmitters. The controller 81 is in signal communication with the one or more rudder servo motors 83*a* and 83*b* and the sail element 61 through the sail control element 85 to set a course for the hull form 15 by directing the first rudder 77 and second rudder 79 to turn and set a sail element 61 position in cooperation with the course to power the apparatus 11.

The sail control element 85 may take several forms. The sail control element 85 may comprise a servo tab and the position of the servo tab may be adjusted to position the sail element 61. In the alternative, the sail element 61 can be held by one or more lines or spars which can move the sail element 61 about a mast. In the power position, as shown in FIG. 4, the sail element 61 will have the forward aspect 89 of the sail or foil towards the first side 31 and to which the keel element 41 is offset and does not need to have complete freedom of rotation. Or, in a further alternative, the sail element 61 is fixed to a ring gear [not shown] or similar device attached to the wing spar [not shown] which goes thru the deck and steps on the hull bottom. The ring gear is driven by a motor driven pinion gear [not shown] that can position the wing anywhere in 360 degrees and hold it in place. A spar or the mast may also be mechanically coupled to a cogged belt, chain, and a motor driven pinion gear [not shown].

Embodiments of the present method will now be described in detail with respect to the operation of apparatus 11. Turning now to FIG. 2, the keel element 41 has at least a one segment in which the first keel side surface 47 and second keel side surface 49 have an offset angle toward the first hull side 31. A sail element projects 61 from the hull upper surface 17 about the mid-line 35 for receiving and responding aerodynamically to relative movement of the first fluid body, water, and the second fluid body, air. The hull form 15 has an at rest position in which the sail element 61 is not receiving and responding to relative movement of the first fluid body and the second fluid body. In the at rest position, the sail element 61 and the interphase of the first fluid body, water, and the second fluid body, air, the waterline 13 define a first rest angle towards the first side 65 and a second rest angle 67 towards the second side. The first rest angle 65 is smaller than the second rest angle 67. The center of buoyancy 71 is towards the first hull side 31. In the power position, as depicted in FIG. 3, the sail element 61 and the interphase of the first fluid body, water, and the second body of fluid, air, the waterline 13 the sail element responds to the relative motion. The sail element 61 is receives and responds to the relative movement of the first fluid body and the second fluid body to define a first power angle 65' towards the first side 31 and a second power angle 67' towards the second side 33. The first power angle 65" is larger than the first rest angle 65 and approaches or exceeds the second power angle 67'.

Turning now to FIG. 4, the apparatus 11 tacks by turning the hull form 15 and keel element 41, with the first end 23 leading to place the first hull side 31 toward the apparent direction of the second fluid body, air, the apparent wind direction. The sail element 61 is brought to a nonpower position with the leading edge 89 facing the wind, and then bringing the sail element 61 into a power position reversing the sail element 61 side facing the apparent wind to direct power in the direction of the second end 25 of the hull form 15. On the tack, the hull form 15 reveres the direction.

The method further comprises the step of providing a controller 81 and programming the controller 81 to tack by turning the hull form 15 and keel element 41 with the first end 23 leading to place the first side 31 toward the apparent direction of the second fluid body and reversing direction with the second end 25 leading.

A course with these tacking movements are programmed into suitable controllers 81 and the controller calculates or plots series of steps to consistent with the course through a series of tacks. Thus, embodiments of the present invention are well suited, due to their simplicity, for use as marine drones.

Embodiments of the present invention provide a boat design, substantially symmetrically fore and aft and incorporates a sailplan that can be reversed in direction. Instead of tacking in the conventional manner the boat is turned end for end so that what was the bow is now the stern and the angled ballast keel is still positioned to the windward side.

The invention combines the favorable attributes of the swing keel but eliminates its structural complexity by employing an end for end tacking configuration to the hull form and sails.

Thus we have described the apparatus and method of the present invention in detail with the understanding that the description herein is subject to alteration and modification without departing from the teaching herein. Therefore, the subject matter of the invention should not be limited to the precise details but should encompass the subject matter of the claims that follow and their equivalents.

The invention claimed is:

1. An apparatus for movement at the interphase of a first fluid body comprising a liquid and a second fluid body comprising a gas, said apparatus comprising:

a. a hull form having buoyancy in said first body to float at said interphase of said first fluid body and said second fluid body, said hull form having an upper hull surface, bottom hull surface, first hull end, second hull end, first hull side and a second hull side, said first hull end, second hull end define a hull mid-line and a mid-plane, said mid-plane running between said first hull side and second hull side, said hull form substantially symmetrical about said mid plane, said upper hull surface for positioning towards said second fluid and said bottom hull surface for immersion in said first fluid;

b. a keel element affixed to and descending from said hull bottom surface and having a first keel end toward said first hull end, a second keel end towards said second hull end, a first keel side surface facing towards said first hull side and a second keel side surface towards said second hull side, said keel element and hull form having a line of attachment which line of attachment is parallel to or on a line from the first end to said second end, and said keel element having at least a one segment in which the first keel side surface and second keel side surface have an offset angle toward said first hull side;

c. a sail element projecting from said hull upper surface about said mid-line, said sail element for receiving and responding aerodynamically to relative movement of said first fluid body and said second fluid body;

d. said hull form having an at rest position in which the sail element is not receiving and responding to relative movement of the first fluid body and said second fluid body and a power position in which said sail element is receiving and responding to the relative movement of said first fluid body and said second fluid body; in said at rest position said sail element and said interphase of said first fluid body and said second fluid body define a first rest angle towards said first side and a second rest angle towards said second side, said first rest angle is smaller than said second rest angle, and in said power position said sail element and said interphase of said first fluid body and said second fluid body define a first power angle towards said first side and a second power angle towards said second side, said first power angle is larger than first rest angle and approaches or exceeds said second power angle;

e. said apparatus tacking by rotating the hull form and keel element to place the first hull side toward the apparent direction of the second fluid body.

2. The apparatus of claim 1 in which the first fluid body is water and the second fluid body is air.

3. The apparatus of claim 1 wherein said sail element is selected from the group consisting of one or more sails, wings and foils.

4. The apparatus of claim 1 wherein said tacking compels changes the hull end which faces the direction of the movement.

5. The apparatus of claim 1 further comprising a controller.

6. The apparatus of claim 1 further comprising a first rudder towards said first end and a second rudder towards said second end.

7. A method for move an apparatus at the interphase of a first fluid body comprising a liquid and a second fluid body comprising a gas, said apparatus comprising:

a. a hull form having buoyancy in said first body to float at said interphase of said first fluid body and said second fluid body, said hull form having an upper hull surface, bottom hull surface, first hull end, second hull end, first hull side and a second hull side, said first hull end, second hull end define a hull mid-line and a mid-plane, said mid-plane running between said first hull side and second hull side, said hull form substantially symmetrical about said mid plane, said upper hull surface for positioning towards said second fluid and said bottom hull surface for immersion in said first fluid;

b. a keel element affixed to and descending from said hull bottom surface and having a first keel end toward said first hull end, a second keel end towards said second hull end, a first keel side surface facing towards said first hull side and a second keel side surface towards said second hull side, said keel element and hull form having a line of attachment which line of attachment is parallel to or on a line from the first end to said second end, and said keel element having at least a one segment in which the first keel side surface and second keel side surface have an offset angle toward said first hull side;

c. a sail element projecting from said hull upper surface about said mid-line, said sail element for receiving and responding aerodynamically to relative movement of said first fluid body and said second fluid body;

d. said hull form having an at rest position in which the sail element is not receiving and responding to relative movement of the first fluid body and said second fluid body and a power position in which said sail element is receiving and responding to the relative movement of said first fluid body and said second fluid body; in said at rest position said sail element and said interphase of said first fluid body and said second fluid body define a first rest angle towards said first side and a second rest angle towards said second side, said first rest angle is smaller than said second rest angle, and in said power position said sail element and said interphase of said first fluid body and said second fluid body define a first power angle towards said first side and a second power angle towards said second side, said first power angle is larger than first rest angle and approaches or exceeds said second power angle;

e. said apparatus tacking by rotating the hull form and keel element to place the first hull side toward the apparent direction of the second fluid body; said method comprising the step of rotating the hull form and keel element to place the first hull side toward the apparent direction of the second fluid body and reversing the direction of the hull form in the first fluid body.

* * * * *